US005279269A

United States Patent [19]

Aizawa et al.

[11] Patent Number: 5,279,269

[45] Date of Patent: Jan. 18, 1994

[54] SUPERCHARGED 4-CYCLE ENGINE

[75] Inventors: Shigemitsu Aizawa; Takeshi Yamakoshi, both of Matsumoto, Japan

[73] Assignee: Ishikawajima-Shibaura Machinery Co., Ltd., Tokyo, Japan

[21] Appl. No.: 13,926

[22] Filed: Feb. 5, 1993

[30] Foreign Application Priority Data

Feb. 14, 1992 [JP] Japan ..... 4-28536

[51] Int. Cl.[5] ..... F02B 75/02

[52] U.S. Cl. ..... 123/317

[58] Field of Search ..... 123/317, 196 R, 572

[56] References Cited

FOREIGN PATENT DOCUMENTS 47-35516 11/1972 Japan .

61-200330 9/1986 Japan .

*Primary Examiner*—Noah Kamen

*Attorney, Agent, or Firm*—Oblon, Spivak, McClelland, Maier & Neustadt

[57] ABSTRACT

In a supercharged 4-cycle engine including an intake passage connecting a fuel-air mixture forming section to a crank chamber, and a supercharging chamber connecting the crank chamber through an intake port to a combustion chamber, wherein when a piston is reciprocated to change a volume of the crank chamber, a fuel-air mixture is sucked from the intake passage into the crank chamber, and the fuel-air mixture compressed in the crank chamber is discharged into the supercharging chamber; a space accommodating a valve operating mechanism inclusive of a rocker arm is communicated with the supercharging chamber. Accordingly, even when a volume of the supercharging chamber itself is small, a supercharging volume 10–20 times a displacement of the engine can be substantially ensured.

3 Claims, 3 Drawing Sheets

SUPERCHARGED 4-CYCLE ENGINE

BACKGROUND OF THE INVENTION

1. Field of the Invention

The present invention relates to a supercharged 4-cycle engine adapted to supply a fuel-air mixture through a crank chamber into a combustion chamber and compress the fuel-air mixture by utilizing a change in volume of the crank chamber in association with reciprocation of a piston.

2. Description of the Related Art

Conventionally known from Japanese Patent Laid-open Nos. 47-35516 and 61-200330 is a supercharged 4-cycle engine adapted to supply a fuel-air mixture through a crank chamber into a combustion chamber and compress the fuel-air mixture by utilizing a change in volume of the crank chamber in association with reciprocation of a piston. A typical structure of such a supercharged 4-cycle engine will be described with reference to FIGS. 2 to 4.

FIG. 2 shows a general structure of a single-cylinder supercharged 4-cycle engine. A cylinder 2 is mounted to an upper portion of a crank case 1. A cylinder head 3 is mounted to an upper portion of the cylinder 2. A crank shaft 5 is provided in a space (crank chamber) 4 of the crank case 1 so as to be rotatably supported to bearings (not shown). A piston 6 adapted to be slidably reciprocated in the cylinder 2 is connected through a connecting rod 7 to the crank shaft 5. A cam shaft 8 is provided in the crank chamber 4 so as to be rotatably supported to bearings (not shown). A crank gear 9 is press-fitted to the crank shaft 5 at one end thereof. A cam gear 10 is press-fitted to the cam shaft 8 at one end thereof. The crank gear 9 is in mesh with the cam gear 10. The number of teeth of the cam gear 10 is set to be twice the number of teeth of the crank gear 9. An intake cam 11 and an exhaust cam (not shown) for respectively driving an intake valve and an exhaust valve to be hereinafter described are fixed to the cam shaft 8.

A rocker cover 12 is mounted on an upper end of the cylinder head 3 to define a valve operating mechanism accommodating space 13. A valve operating mechanism 18*a* is accommodated in the space 13 surrounded by the rocker cover 12. An intake port 15 is formed in the cylinder head 3 so as to communicate with a combustion chamber 14 in the cylinder 2. An intake valve 16 is supported in the cylinder head 3 so as to open and close the intake port 15. Similarly, an exhaust port (not shown) is formed in the cylinder head 3 so as to communicate with the combustion chamber 14, and an exhaust valve (not shown) is supported in the cylinder head 3 so as to open and close the exhaust port. The valve operating mechanism 18*a* includes a spring 17 for biasing the intake valve 16 in a valve closing direction thereof, a spring (not shown) for biasing the exhaust valve in a valve closing direction thereof, and a rocker arm 18 for biasing the intake valve 16 in a valve opening direction thereof. An adjusting screw 19 is threadedly engaged with the cylinder head 3, and the rocker arm 18 is rockably mounted at its central portion to the adjusting screw 19 over the cylinder head 3. An upper end of the intake valve 16 is in contact with one end of the rocker arm 18. The other end of the rocker arm 18 is in contact with an upper end of a push rod 20. A tappet 21 is fixed to a lower end of the push rod 20, and is in contact with the intake cam 11. Although not shown, another valve operating mechanism for operating the exhaust valve is similarly constructed. A push rod passage 22 is formed around the push rod 22. The push rod passage 22 is communicated through a communication hole 23 with the crank chamber 4. Accordingly, the valve operating mechanism accommodating space 13 is in communication with the crank chamber 4.

A carburetor 24 for forming a fuel-air mixture is connected through an intake passage 25 to the crank chamber 4. A reed valve 26 is provided at a connecting portion between the intake passage 25 and the crank chamber 4 so as to permit suction only of the fuel-air mixture into the crank chamber 4. Further, the crank chamber 4 is connected through a supercharging chamber 27 to the intake port 15. A reed valve 28 is provided at a connecting portion between the crank chamber 4 and the supercharging chamber 27 so as to permit discharge only of the fuel-air mixture from the crank chamber 4 into the supercharging chamber 27.

In a compression stroke and an exhaust stroke of the engine, the piston 6 is lifted to increase a volume of the crank chamber 4 and reduce a pressure in the crank chamber 4. Accordingly, the reed valve 26 is opened as shown in FIG. 3, and the fuel-air mixture formed in the carburetor 24 is sucked through the intake passage 25 into the crank chamber 4. On the other hand, in an explosion stroke and an intake stroke of the engine, the piston 6 is lowered to decrease the volume of the crank chamber 4 and increase the pressure in the crank chamber 4. Accordingly, the reed valve 28 is opened as shown in FIG. 4, and the fuel-air mixture in the crank chamber 4 is discharged into the supercharging chamber 27. Accordingly, the fuel-air mixture in a compressed and high-pressure condition is stored in the supercharging chamber 27. This mixture having a high pressure is supplied through the intake port 15 into the combustion chamber 14 when the intake valve 16 is opened in the intake stroke.

The provision of the supercharging chamber 27 brings about an increase in quantity of the fuel-air mixture to be supplied into the combustion chamber 14 by 30–40% as compared with a normal aspiration type engine. Further, in order to reduce a fluctuation in supercharging pressure and effect stable supply of the fuel-air mixture, a volume of the supercharging chamber 27 is set to a value 10–20 times a displacement of the engine.

An output of such a supercharged engine can be improved by increasing a compression ratio of the fuel-air mixture in the crank chamber 4 to increase a supercharging efficiency. The compression ratio in the crank chamber 4 can be expressed as follows:

$$\text{Compression ratio} = (V_D + V_C)/V_C = V_D/V_C + 1$$

where $V_D$ represents a displacement of the engine, and $V_C$ represents a volume of the crank chamber 4 at a bottom dead center of the piston 6 plus a volume of the space communicated with the crank chamber 4 (i.e., the valve operating mechanism accommodating space 13 and the push rod passage 22). Accordingly, in order to increase the compression ratio, it is necessary to reduce the value of $V_C$.

Regarding lubrication in the crank chamber 4, a lubricating oil is preliminarily mixed with a fuel, and such a mixed fuel containing the lubricating oil is atomized in the carburetor 24 to become a fuel-air mixture which is in turn sucked into the crank chamber 4, thereby effecting lubrication in the crank chamber 4. Further, the fuel-air mixture containing the lubricating oil in the crank chamber 4 is partially supplied through the communication hole 23 and the push rod passage 22 into the valve operating mechanism accommodating space 13, thereby effecting lubrication in the space 13 accommodating the valve operating mechanism 18*a* (especially, a contact portion between the rocker arm 18 and the push rod 20, and a contact portion between the rocker arm 18 and the intake valve 16).

As apparent from the above expression relating to the compression ratio, it is optimum to reduce the volume of the space 13 constituting the space communicated with the crank chamber 4, in order to increase the compression ratio of the fuel-air mixture. However, since the rocker arm 18 adapted to be rocked is accommodated in the space 13, it is difficult to greatly reduce the volume of the space 13. Accordingly, it is difficult to expect the improvement in engine output by increasing the compression ratio.

Further, as mentioned previously, it is necessary to set the volume of the supercharging chamber 27 to a value 10–20 times the displacement, in order to reduce a fluctuation in supercharging pressure. Accordingly, the supercharging chamber 27 is constructed in an expanded condition as shown in FIG. 2, and it is therefore difficult to make the engine compact.

Further, the valve operating mechanism 18*a* is one of the most necessary portions to be lubricated, and the lubricating oil for lubricating the valve operating mechanism 18*a* is supplied together with the fuel-air mixture through the communication hole 23 and the push rod passage 22 into the space 13. However, replacement of the fuel-air mixture between the crank chamber 4 and the space 13 through the communication hole 23 and the push rod passage 22 cannot be well performed. Accordingly, the lubrication of the valve operating mechanism 18*a* cannot be sufficiently effected.

SUMMARY OF THE INVENTION

It is accordingly an object of the present invention to provide a supercharged 4-cycle engine adapted to effect supercharging by utilizing a crank chamber, which can improve an output by an increase in compression ratio in the crank chamber.

It is another object of the present invention to provide such a supercharged 4-cycle engine which can sufficiently effect the lubrication of a valve operating mechanism.

It is a further object of the present invention to provide such a supercharged 4-cycle engine which can be made compact as a whole.

According to the present invention, there is provided in a supercharged 4-cycle engine including an intake passage connecting a fuel-air mixture forming section to a crank chamber, and a supercharging chamber connecting the crank chamber through an intake port to a combustion chamber, wherein when a piston is reciprocated to change a volume of the crank chamber, a fuel-air mixture is sucked from the intake passage into the crank chamber, and the fuel-air mixture compressed in the crank chamber is discharged into the supercharging chamber; the improvement wherein a space accommodating a valve operating mechanism inclusive of a rocker arm is communicated with the supercharging chamber.

With this construction, the valve operating mechanism accommodating space and the supercharging chamber are communicated with each other. Accordingly, the valve operating mechanism accommodating chamber can be utilized as a part of the supercharging chamber. As a result, the volume of the supercharging chamber itself can be reduced, and a degree of expansion of the supercharging chamber can therefore be reduced to make the engine compact.

Further, the fuel-air mixture discharged from the crank chamber into the supercharging chamber contains a lubricating oil. Accordingly, this mixture containing the lubricating oil is partially supplied into the valve operating mechanism accommodating space, and the replacement of the mixture in the space can be well performed. Therefore, the lubrication of the valve operating mechanism including the rocker arm in the space can be sufficiently effected.

Further, it is unnecessary to communicate the valve operating mechanism accommodating space with the crank chamber for the purpose of lubrication of the valve operating mechanism. Accordingly, the compression ratio of the fuel-air mixture in the crank chamber can be increased to thereby easily improve a supercharging efficiency and easily improve an engine output.

Other objects and features of the invention will be more fully understood from the following detailed description and appended claims when taken with the accompanying drawings.

DETAILED DESCRIPTION OF THE PREFERRED EMBODIMENTS

Figure 1:
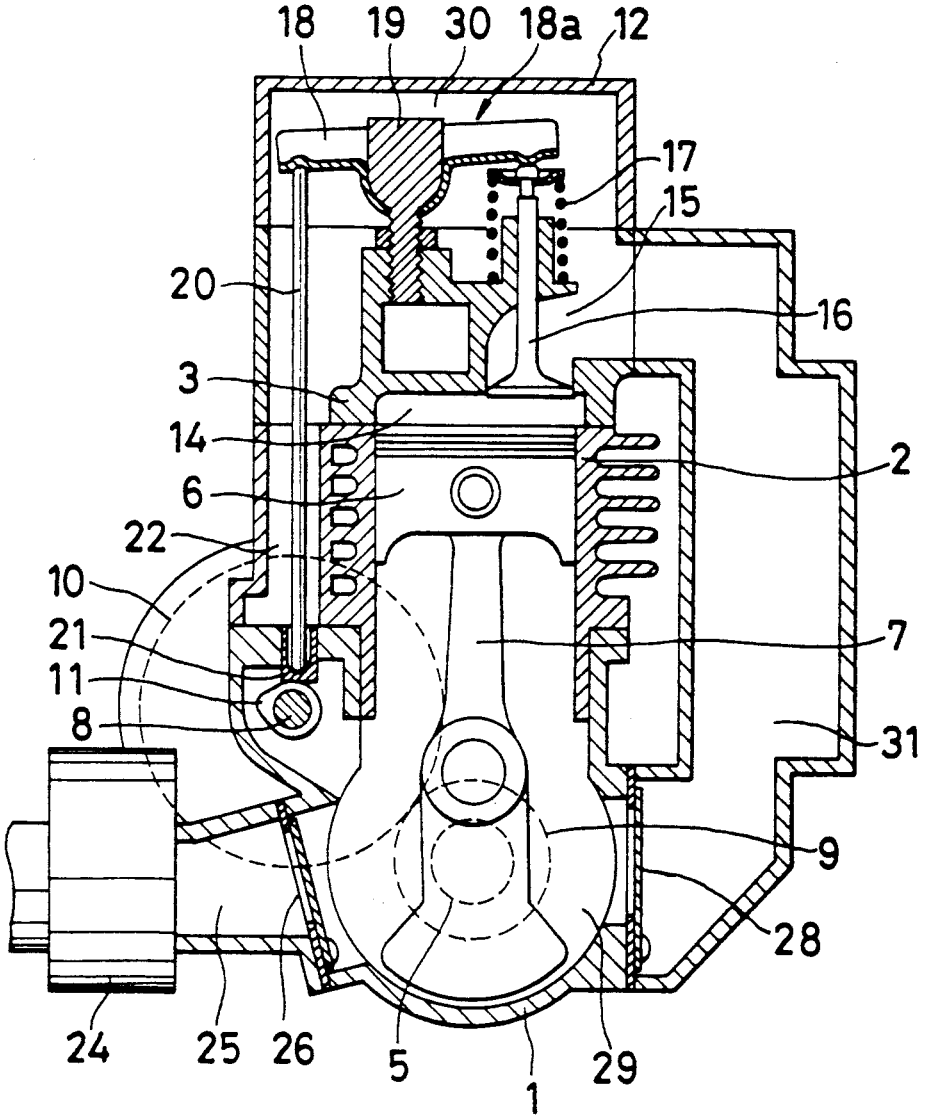
FIG. 1 is a vertical sectional elevation of an engine in a preferred embodiment according to the present invention.
Figure 3:
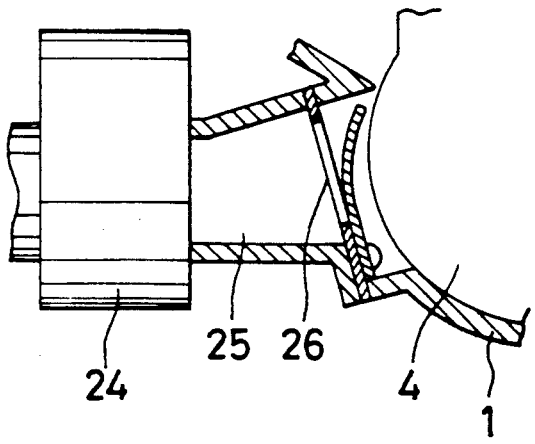
FIG. 3 is a vertical sectional elevation illustrating a condition where a fuel-air mixture is sucked into a crank chamber in the engine shown in FIG. 2.
Figure 4:
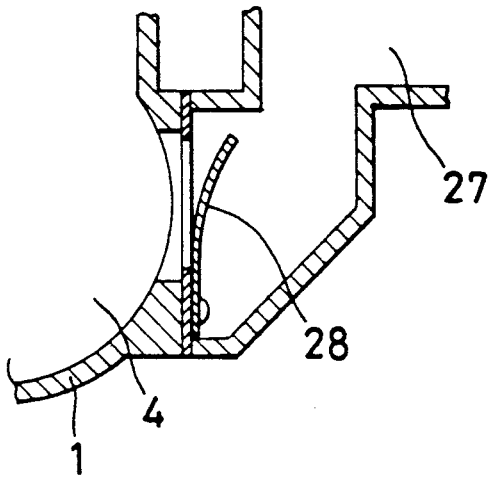
FIG. 4 is a vertical sectional elevation illustrating a condition where the fuel-air mixture in the crank chamber is discharged into a supercharging chamber in the engine shown in FIG. 2.

A preferred embodiment of the present invention will now be described with reference to FIG. 1, in which the same reference numerals as those shown in FIGS. 2 to 4 designate the same parts, and the explanation thereof will be omitted hereinafter. Referring to FIG. 1, a crank chamber 29 is defined in a crank case 1, and a valve operating mechanism accommodating space 30 is so defined as to be surrounded by a rocker cover 12 over a cylinder head 3. A crank shaft 5 and a cam shaft 8 are provided in the crank chamber 29 in the same manner as that in the prior art shown in FIG. 2. A carburetor 24 as a fuel-air mixture forming section for forming a fuel-air mixture is connected through an intake passage 25 to the crank chamber 29. A valve operating mechanism 18*a* including a rocker arm 18 is provided in the space 30 in the same manner as that in the prior art shown in FIG. 2. However, unlike the prior art shown in FIG. 2, the crank chamber 29 is not communicated with the space 30.

A supercharging chamber 31 is so defined as to communicate the crank chamber 29 with an intake port 15 formed in the cylinder head 3. The supercharging chamber 31 is also communicated with the space 30.

Figure 2:
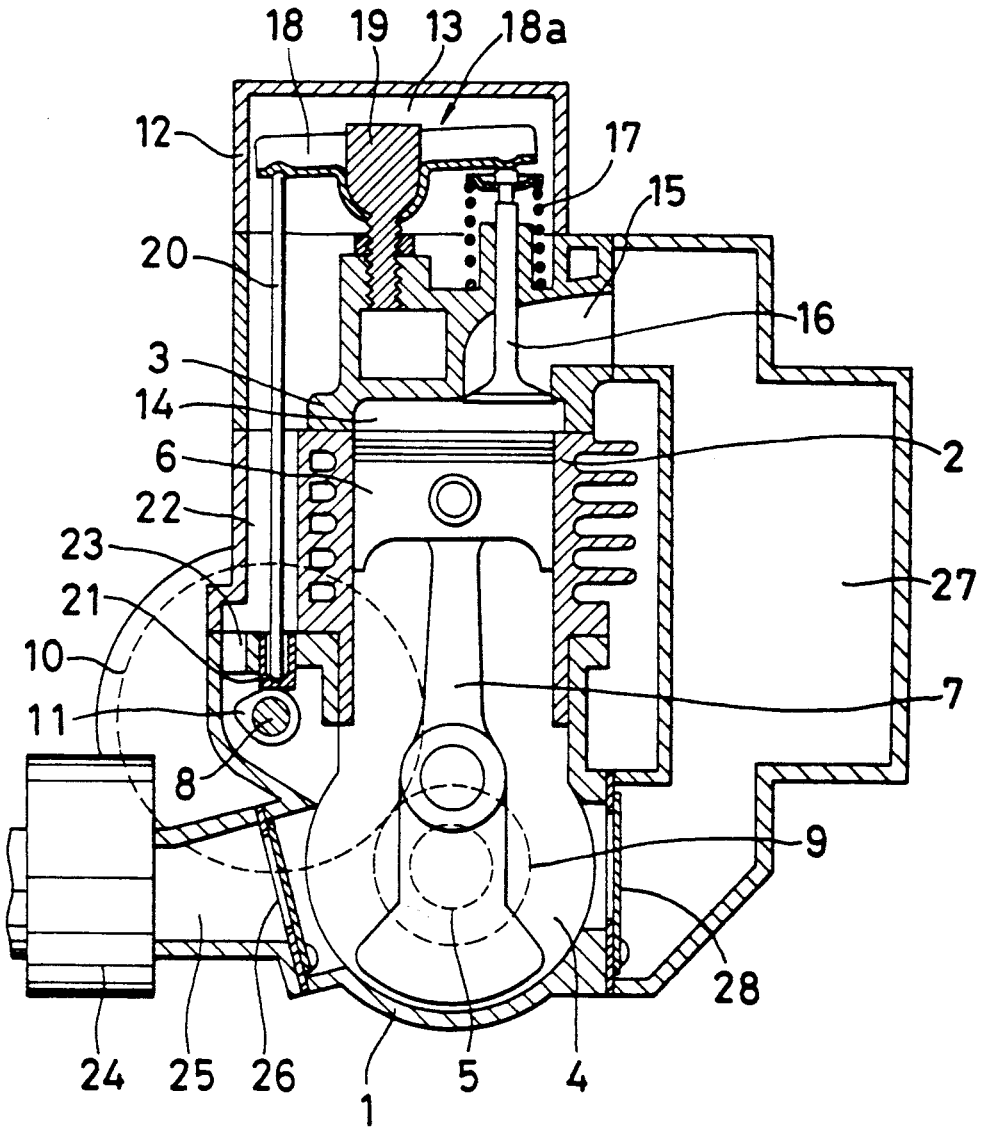
FIG. 2 (PRIOR ART)
FIG. 2 is a vertical sectional elevation of an engine in the prior art.

In operation, suction of the fuel-air mixture from the intake passage 25 into the crank chamber 29 and discharge of the fuel-air mixture from the crank chamber 29 into the supercharging chamber 31 are performed in association with sliding operation of a piston 6 in the same manner as that in the prior art shown in FIG. 2. Then, the fuel-air mixture having a high pressure stored in the supercharging chamber 31 is supplied through the intake port 15 into a combustion chamber 14 when an intake valve 16 is opened in an intake stoke.

Since the space 30 and the supercharging chamber 31 are communicated with each other, the space 30 serves as a part of the supercharging chamber 31. Accordingly, the volume of the supercharging chamber 31 itself can be reduced to thereby reduce a degree of expansion of the supercharging chamber 31. As a result, the engine can be made compact. Further, since the space 30 and the supercharging chamber 31 are communicated with each other, the compressed fuel-air mixture containing a lubricating oil in the supercharging chamber 31 is partially supplied into the space 30, and the replacement of the fuel-air mixture in the space 30 can be well performed. Accordingly, lubrication of the valve operating mechanism 18*a* by the lubricating oil contained in the fuel-air mixture can be sufficiently effected. Further, since it is unnecessary to communicate the space 30 with the crank chamber 29 for the purpose of lubrication of the valve operating mechanism 18*a*, the space communicated with the crank chamber 29 is reduced in volume, thereby reducing the value of $V_C$ indicated in the above expression. Accordingly, the compression ratio of the fuel-air mixture in the crank chamber 29 can be increased to thereby improve a supercharging efficiency and improve an output of the engine.

Although the supercharging chamber 31 is in direct communication with the space 30 in the above preferred embodiment, the supercharging chamber 31 may be communicated through the push rod passage 22 to the space 30.

As described above, according to the present invention, in a supercharged 4-cycle engine including an intake passage connecting a fuel-air mixture forming section to a crank chamber, and a supercharging chamber connecting the crank chamber through an intake port to a combustion chamber, wherein when a piston is reciprocated to change a volume of the crank chamber, a fuel-air mixture is sucked from the intake passage into the crank chamber, and the fuel-air mixture compressed in the crank chamber is discharged into the supercharging chamber; it is featured that a space accommodating a valve operating mechanism inclusive of a rocker arm is communicated with the supercharging chamber. Accordingly, the valve operating mechanism accommodating chamber can be utilized as a part of the supercharging chamber. As a result, the volume of the supercharging chamber itself can be reduced, and a degree of expansion of the supercharging chamber can therefore be reduced to make the engine compact. Further, the fuel-air mixture discharged from the crank chamber into the supercharging chamber contains a lubricating oil. Accordingly, this mixture containing the lubricating oil is partially supplied into the valve operating mechanism accommodating space, and the replacement of the mixture in the space can be well performed. Therefore, the lubrication of the valve operating mechanism including the rocker arm in the space can be sufficiently effected. Further, it is unnecessary to communicate the valve operating mechanism accommodating space with the crank chamber for the purpose of lubrication of the valve operating mechanism. Accordingly, the compression ratio of the fuel-air mixture in the crank chamber can be increased to thereby easily improve a supercharging efficiency and easily improve an engine output.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

We claim:

1. In a supercharged 4-cycle engine including an intake passage connecting a fuel-air mixture forming section to a crank chamber, and a supercharging chamber connecting said crank chamber through an intake port to a combustion chamber, wherein when a piston is reciprocated to change a volume of said crank chamber, a fuel-air mixture is sucked from said intake passage into said crank chamber, and said fuel-air mixture compressed in said crank chamber is discharged into said supercharging chamber; the improvement wherein a space accommodating a valve operating mechanism inclusive of a rocker arm is communicated with said supercharging chamber, and a volume of said space plus a volume of said supercharging chamber are set to a value 10–20 times a displacement of said engine.

2. The supercharged 4-cycle engine as defined in claim 1, wherein said crank chamber and said space are not in direct communication with each other.

3. A supercharged 4-cycle engine comprising:

an intake passage which connects a fuel-air mixture forming section to a crank chamber;

a supercharging area including a supercharging chamber and a valve operating mechanism accomodating space, said supercharging chamber connecting said crank chamber through an intake port to a combustion chamber, said valve operating mechanism accomodating space being in communication with said supercharging chamber and having a rocker arm positioned therein; and a reciprocating piston which reciprocates to change a volume of said crank chamber so as to suck a fuel-air mixture from said intake passage into said crank chamber, compress said fuel-air mixture in said crank chamber, and discharge said compressed fuel-air mixture into said supercharging chamber which is thereafter partially supplied to said valve operating mechanism accomodating space.

* * * * *